United States Patent [19]

Celi

[11] 4,121,449

[45] Oct. 24, 1978

[54] HOLDING-DOWN ARRANGEMENT FOR A DEEP-DRAWING PRESS

[75] Inventor: Antonio M. Celi, Neustadt, Wied, Fed. Rep. of Germany

[73] Assignee: Hermann Etscheid OHG, Neustadt, Wied, Fed. Rep. of Germany

[21] Appl. No.: 774,693

[22] Filed: Mar. 7, 1977

[30] Foreign Application Priority Data

Mar. 10, 1976 [DE] Fed. Rep. of Germany ..... 2609916
Aug. 26, 1976 [DE] Fed. Rep. of Germany ... 7607297[U]

[51] Int. Cl.[2] ..... B21D 22/00

[52] U.S. Cl. ..... 72/500; 72/361; 91/4 R

[58] Field of Search ..... 72/350, 361, 422; 83/390; 269/25; 91/4

[56] References Cited

U.S. PATENT DOCUMENTS

| | | | |
|---|---|---|---|
| 2,403,912 | 7/1946 | Doll | 269/28 UX |
| 2,916,017 | 12/1959 | Lamb | 71/4 X |
| 3,286,496 | 11/1966 | Burk | 72/350 |
| 3,532,017 | 10/1970 | Schleeter | 83/390 |
| 3,664,172 | 5/1972 | Cuacho | 72/350 |
| 3,668,914 | 6/1972 | Abudemcherkaza | 72/350 |
| 3,908,496 | 9/1925 | Moelbert | 83/390 X |

*Primary Examiner*—Leon Gilden
*Attorney, Agent, or Firm*—Michael J. Striker

[57] ABSTRACT

The invention relates to a holding-down apparatus for a deep-drawing press. It is known for the deep-drawing of particularly heavy platines that the holding-down of the platine by the holding plate is of very great significance for the quality of the workpiece. The setting of the respective correct holding-down forces is decisive for whether the workpiece is flat and without folds or tears at the drawing flange and at the deformation zone when it comes out of the deep-drawing press. A too high holding force hinders the reduction of the workpiece diameter which is derived from the stroke of the deep-drawing and overloads therefore the vicinity of the border of the deformation zone. A too low holding-down force leads to the formation of folds.

16 Claims, 9 Drawing Figures

HOLDING-DOWN ARRANGEMENT FOR A DEEP-DRAWING PRESS

BACKGROUND OF THE INVENTION

Formerly one had clamped steel springs, predominantly used as a holding-down apparatus, in the configuration of coil springs and dish springs between the pressure plate of the deep-drawing press and the holding plate. Also, rubber springs found useage. All of these springs have the common disadvantage that their spring force increases relatively steeply in the course of the spring movement. The corresponding spring characteristic curves are schematically illustrated in FIG. 1, and indeed as characteristic curve "A" for coil springs and as characteristic curve "B" for dish springs. Further explanation of the FIG. 1 illustration will given at the beginning of the exemplary embodiment.

An optimal deep-drawing operation only comes into practice if one apportions the holding-down force correctly to the material and correctly to the work tool and if this force remains constant during the entire deep-drawing process, thus having a characteristic curve I parallel to the abscissa in the context of the FIG. 1 illustration. This standard cannot be achieved with steel-or rubber springs, because their characteristic curves intersect the ideal characteristic curve I at a single point; the holding-down force practised by them remains too small on the spring curve lying before this point and is too large after this ideal point. If one would adjust the springs without pre-tension, then the holding-down force practised by them would equal zero at the beginning of the deep-drawing process.

A further disadvantage of the known holding-down apparatuses comprised of spring elements occurs by the short operative spring path which is still shorter due to the absolutely required pre-tension, compare FIG. 1. One is obliged on account of the short spring path to execute the deep-drawing process in several draws, in order to obtain a flat workpiece.

In recognition of this state of affairs one has in recent years desired to develop gas springs which have a flat characteristic curve. One such pneumatic holding-down apparatus has been very well known on the market. It comprises a plurality of piston cylinders whose cylindrical chambers communicate with a large pressure container. Piston cylinder and pressure container are filled with nitrogen at high pressure of 100 bar in the overall arrangement. The entire volume of all piston cylinders should be considerably smaller than the volume of the pressure container arranged to them. Under this premise a plunging of all pistons into the piston cylinders changes the total pressure relatively slightly. If the piston cylinders are positioned as holding-down apparatuses between a pressure plate and a holding plate, then the gas resistance remains substantially constant opposite the piston movement, assuming that the container volume is sufficiently much larger than the sum of the cylinder volumes.

The characteristic curve of this known nitrogen-spring element extends undisputably at a very sharp angle to the coordinate axes of the spring movement. This characteristic curve is identified in FIG. 1 with "C" and cuts the ideal curve I at the point $I_C$. Its inclination in relationship to the ideal curve is according to the technical journal "Strips, Sheets, Pipes", page 449 (1974) about 10%, i.e., corresponding to an angle of about 6 degrees.

An obvious difficulty of this system concerns the very high pressure required also outside the piston cylinder. The large volume pressure container as well as the pressure tube leading from this container to the piston cylinders must be dimensioned according to safety reasons and are therefore also corespondingly expensive. Besides it is complicated and expensive for a system to have to use a special apparatus which must have highly compressed nitrogen in storage.

The operation of the known nitrogen gas spring is controlled by the Boyle-Mariotte Law. This law is however related to an ideal gas and is valid only with limitations for a real gas such as nitrogen. A useful approximation assumes for example that the gas at high pressure has the so-called Boyle temperature which is a predetermined specific temperature for each gas. For nitrogen the Boyle temperature amounts to 56° C.

During the deep-drawing process the temperature of the nitrogen provided in a piston cylinder climbs quickly to a very high value. The nitrogen located in the pressure container remains by contrast at room temperature, on account of the slight heat conductivity of the gas the heat produced in the piston cylinder cannot be transmitted through the nitrogen in the pressure container because no flow is provided in the closed system. The both Boyle-Mariotte volumes work in sequence with widely different temperatures. The result is that one must hold the relationship pressure container — room content/piston cylinder volume very large in order to guarantee the correctness of the Boyle-Mariotte Law with sufficient approximation.

Probably on cost-and safety grounds one in the art goes another way: one constructs the pressure container of the nitrogen gas-spring element on a so-called base plate on which the spring elements are mounted as holding-down elements. By this measure one avoids the heavy and expensive high pressure tubes, however it therefore naturally acquires an invalid volume relationship and a correspondingly steep characteristic curve. A further disadvantage is that the deep-drawing process by this arrangement can only be performed from below upwardly, and therefore is not operative by a plurality of presses.

SUMMARY OF THE INVENTION

The present invention has as the aim to make a holding-down apparatus which does not have the disadvantages of the above-mentioned known holding-down apparatuses, which is simple in construction and in operation, and which requires no great expenses. During the entire deep-drawing path the holding-down apparatus according to the invention should above all generate a holding-down force which is simple to control and which is steady and remain the same, the holding-down apparatus should be capable of producing a precise regulated holding-down of the border of the platine even of deep workpieces without stepwise interruption of the deep-drawing process. As a single pressure source in addition to the pressing force the holding-down apparatus according to the invention requires the operative air pressure arrangement; if such one is not provided, the holding-down apparatus should be able to manage without it in case of emergency. In a particular embodiment adapted to fast mass-production the holding-down apparatus should make the holding plate superfluous.

In order to achieve these invention aims, the inventive concept is drawn from the formerly prevailing spring principle and grounded on the principle of the not-elastic hydraulic art. The deep-drawing pressure force transmitted through the pressure plate to the holding-down apparatus having at least a pressure member is further conducted from each pressure member to a respective pressure chamber which is filled with hydraulic oil and which is effected by the pressure members, the pressure chamber communicating with a closed balance chamber which contains partially hydraulic oil and partially gas and which stands under an approximately constant pressure through an adjutable reducing valve as well as through a balance valve, in which balance chamber the reducing valve opens in the flow direction away from the pressure chamber and the balance valve opens in the flow direction towards the pressure chamber. Hereby, the balance chamber can stand in direction connection with a pressure generator, preferably with the air pressure arrangement of the system.

In a preferred embodiment of the invention, the holding-down apparatus has several adjustable holding-down elements which are adjacent each other, each holding-down element comprising a cylindrical housing closed pressure tightly by a cover and containing a central cylindrical chamber and a cylindrical mantle-shaped balance chamber which is coaxial with the cylindrical chamber, in which central cylindrical chamber a pressure piston lying above the hydraulic oil plunges, while the annular-shaped air space found in the balance chamber is connected through a pressure tube with the air pressure arrangement.

The reducing valve connected to the pressure chamber with the balance chamber can be threaded in a radial bore which is partially provided with a thread and which is formed in the bottom of the housing, and the reducing valve is formed as a needle slide valve which is arranged to be longitudinally slidable by means of a control knob located at the outer wall of the housing, and the radial bore connects a bore which is provided in the housing bottom of the central cylindrical chamber and a bore provided in the housing bottom of the cylindrical mantle-shaped balance chamber with one another.

The balance valve which is screwed into the housing bottom of the cylindrical mantle-shaped balance chamber can open into a radial bore formed in the bottom of the housing and through this radial bore and a somewhat cylindrical parallel axis bore in the bottom of the central cylindrical chamber be connected with the latter, and the radial bore is outwardly pressure-tightly sealed with a stopper bushing threaded therein. Similarly, an over-pressure valve which is threaded into the housing bottom of the cylindrical mantle-shaped balance chamber opens into a radial bore which is provided in the housing bottom and which is pressure tightly sealed outwardly by mans of a stopper bushing, the radial bore being connected with a bore arranged in the central cylindrical chamber.

A mounting support provided with a thread is formed at the outer side of the housing bottom for the purpose of mounting the holding-down element to the holding plate. over-pressure In a particularly advantageous embodiment of the invention the holding-down apparatus is formed as a holding plate which lies directly on the platine, in which holding plate the housing has a central continuous cylindrical chamber provided for the passage of the drawing ram, about which chamber two cylindrical mantle-shaped pressure chambers equipped with a common annular-shaped bottom and a common annular-shaped housing cover are coaxially arranged and are connected with one another through a controllable reducing valve as well as a balance valve and an over-pressure valve, and a cylindrical mantle-shaped pressure piston which is pressure tightly sealed by means of sealing rings project into the inner cylindrical mantle-shaped pressure chamber and lies above the oil filler, while over the oil which is located in the outer cylindrical mantle-shaped pressure room an air space is provided.

Finally, a sealing stopper can be threaded into the threaded bore leading to the air filled portion of the cylindrical mantle shaped balance chamber instead of the tubular support.

BRIEF DESCRIPTION OF THE DRAWINGS

With the aid of the drawings, an exemplary embodiment of the invention is illustrated and explained in sequence. It shows.

DESCRIPTION OF THE PREFERRED EMBODIMENTS

Figure 1:
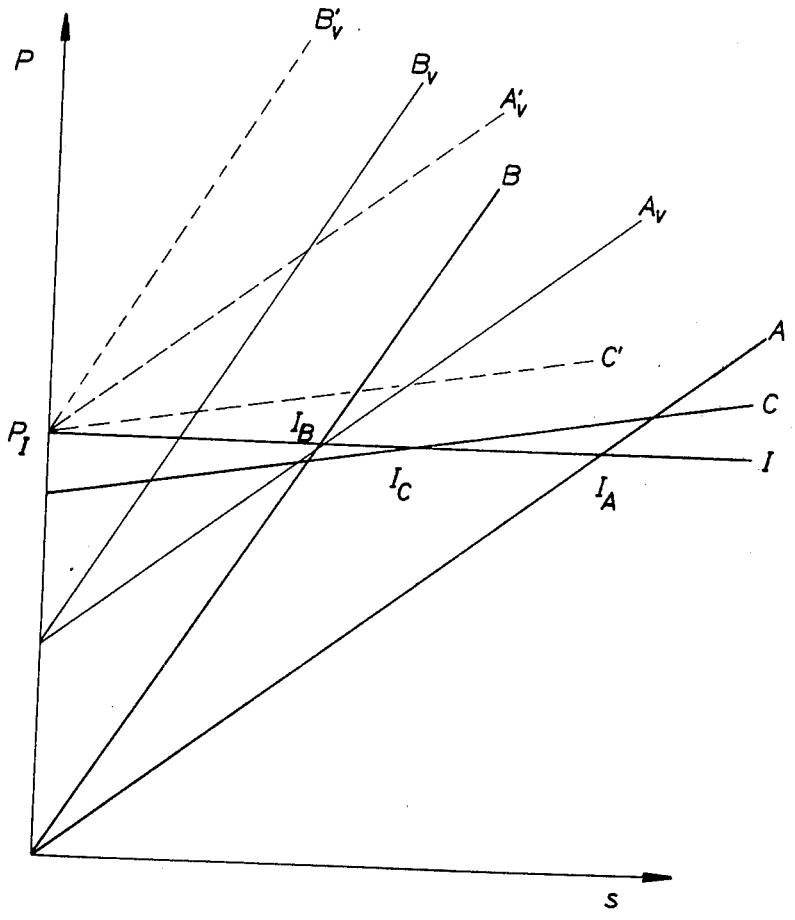
FIG. 1 a characteristic curve diagram, purely schematic with characteristic curve A = coil spring, B = dish spring and C = gas spring, all in relation to the ideal characteristic curve of a holding-down force, FIG. 2 a holding-down element according to the invention as part of a holding-down apparatus, in perspective view, FIG. 3 the section X—X of FIG. 2, FIG. 4 the section Y—Y of FIG. 2, FIG. 5 a holding-down apparatus according to the invention comprised of holding-down elements of FIGS. 1 to 3 in a top view (section Z—Z of FIG. 6), FIG. 6 the FIG. 5 holding-down apparatus in a side view, situated under a pressure plate and above a drawing matrix, FIG. 7 another form of the holding-down element of FIGS. 1 to 3, FIG. 8 the section U—U of FIG. 7 and FIG. 9 a holding-down apparatus comprised of a single element according to the invention, formed in addition as a holding plate and receiving the drawing ram, in side view, and situated under a pressure plate above a drawing matrix.

As already mentioned above, the curve I extending parallel to the abscissa shows in FIG. 1 the ideal characteristic curve of a holding-down force P for a given deep-drawing process. The holding-down force P remains constant over the entire deep-drawing path *s*. The characteristic curves A and B of the coil spring and dish spring serving as holding-down elements intersect the ideal curve I at points $I_A$ and $I_B$, i.e. only at these points does the holding-down element in question fulfill its object in a optimal manner. During the deep-drawer path *s* of the drawing ram 35 into the drawing matrix 33 the spring force of the coil- and dish springs A,B does not grow until it achieves the respective optimum points $I_A$, $I_B$ of the present object of the holding-down; it threatens fold formations at the drawing flange and at the deforming zone. After passing through the optimal points the holding-down springs achieve a large hold-down force as necessary. If the holding-down force increases too steeply then it hinders the drawing of the platine to a smaller cross-section, with the result that the deformation zone experiences a too high loading at the border of the matrix and sustains tears.

As FIG. 1 likewise shows, the above-described nitrogen gas spring element comprises a considerably flatter spring characteristic than the steel springs. However, this spring element also has an optimal holding-down function only at the cross-point $I_C$, i.e., the point which corresponds precisely to the aim of the holding-down function.

The superiority of the nitrogen-spring element relative to the conventional steel spring element is viewable directly from the FIG. 1 illustration. In relationship to the prior-state of the art, the nitrogen-spring element achieves a great advance. However, the fact remains that the characteristic curve of the nitrogen gas spring diverges not insignificantly from the ideal curve.

Opposite that the holding-down apparatus according to the invention, which is initially described hereafter as the construction of a holding-down element which forms together with another holding-down element the holding-down apparatus, has a holding-down force P which remains constant through the entire deep-drawing path and which is continuously adjustable, and can as well be set to the respectively valid $P_I$ value.

The holding-down element (FIGS. 2, 3 and 4) according to the invention comprises a cylindrical housing 1 in which an inner cylindrical wall 3 is arranged coaxially with the outer cylindrical wall 2. The housing 1 is provided with a housing cover 4 in which a central bore 5 is located. The interior of the housing 1 is subdivided into an inner cylindrical chamber 6 and an outer cylindrical jacket-shaped annular chamber 7; compare especially FIG. 4. The housing cover 4 is pressure-tightly sealed against the cylindrical rim 1, 2 by sealing rings 8.

A pressure piston 9 having a piston rod 10 projects into the inner cylindrical chamber 6. At the lower part of the housing a mounting support 11 provided with a screw thread can be formed.

A threaded bore 12, in which a tubular support 13 having a pressure tube 14 is threaded, is located at the upper part of the outer cylindrical wall 2 and is pressure-tightly sealed by a seal 15. The pressure tube 14 leads to the air pressure arrangement 16 of the system.

The housing bottom of the housing 1 has two radially extending valve bores 17, 18. The valve bore 17 connects a vertical bore 19 of annular chamber 7 with a vertical bore 20 of the inner cylindrical chamber 6. The valve bore 17 is provided with a thread 21 between the outer cylindrical wall 2 and the vertical bore 19 of the annular chamber 7. A reducing valve 21 formed as a needle-shaped slide is threaded into this thread 21 and pressure-tightly closes the latter by means of a seal 23. By turning the control knob 24 one can control the flow-through cross-section of the valve bore 17 and therewith the flow speed of the oil flowing therethrough. The flow speed is determinative of the magnitude of the effective holding-down force, because the pressure in the cylindrical chamber 6 depends on it.

The valve bore 18 is connected by a vertical bore 25 with the inner cylindrical chamber 6 and by two additional vertical bores with the cylindrical jacket-shaped annular chamber 7. The vertical bores 26, 27 are provided with threads. A balance valve 28 threads into the vertical bore 26, which then opens if the pressure in annular chamber 7 climbs above the pressure prevailing in the inner cylindrical chamber 6. The flow-through passage of balance valve 28 has a relatively large cross-section and permits the oil to pass quickly therethrough. The threaded bore 27 receives an over-pressure valve 29 whose passage is aligned in the opposite pressure direction and is adjusted to a maximum safety pressure relative to the inner cylindrical chamber 6. The valve bore 18 is closed outwardly by means of a closure screw 30 and a seal 31.

Figure 3:
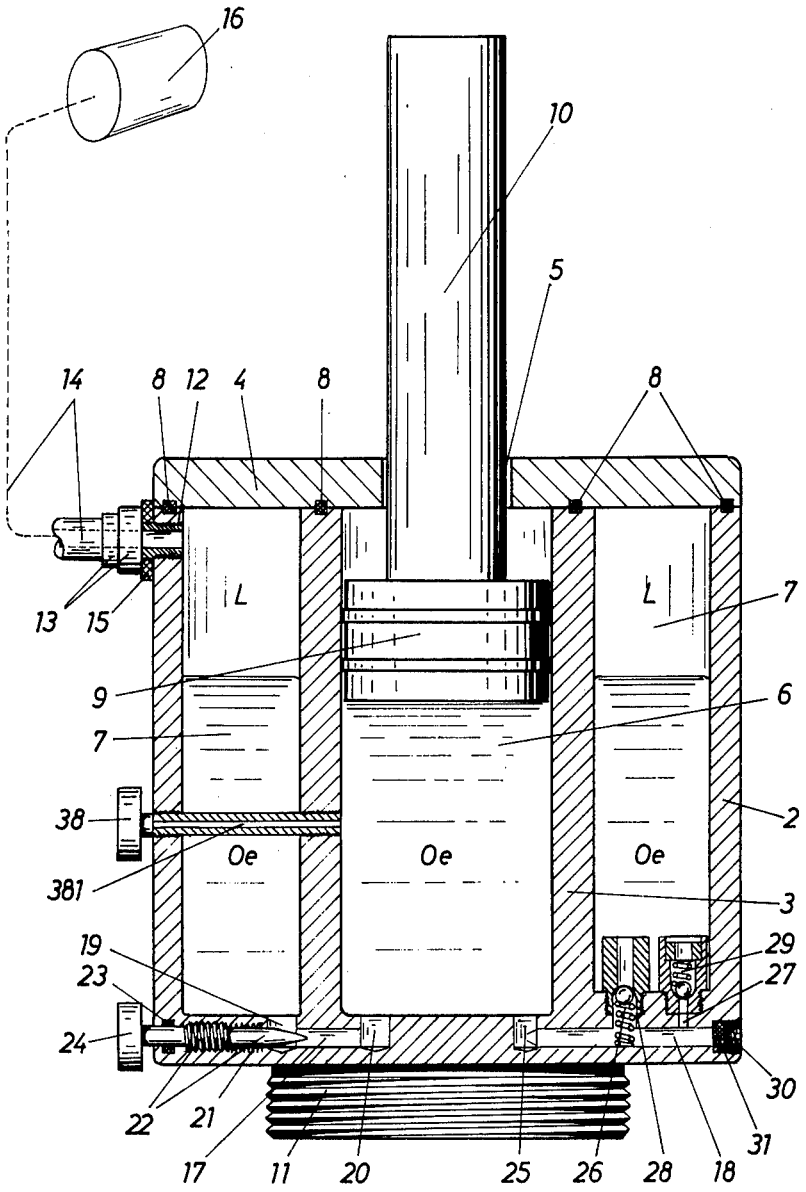
Figure 4:
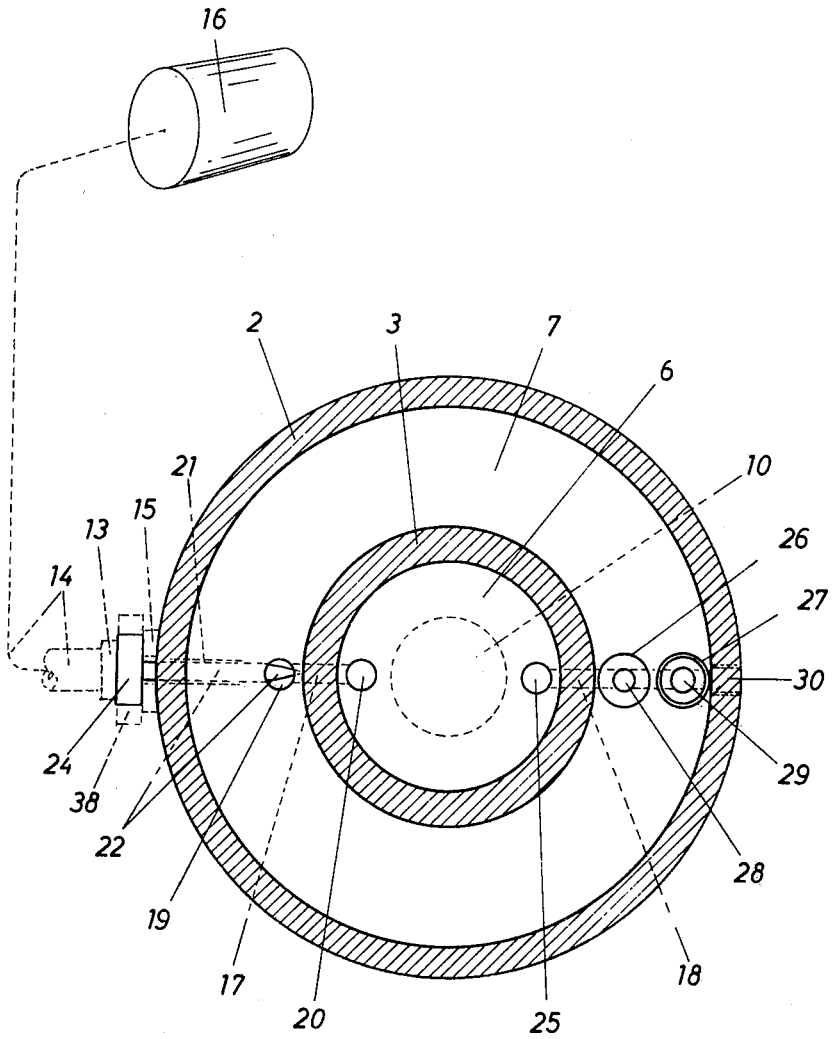

As shown in FIG. 3, hydraulic oil (Oe) is located in the inner cylindrical chamber 6 as well as in the annular chamber 7, and an annular-shaped air space L is provided in the annular chamber 7 above the oil level.

Figure 5:
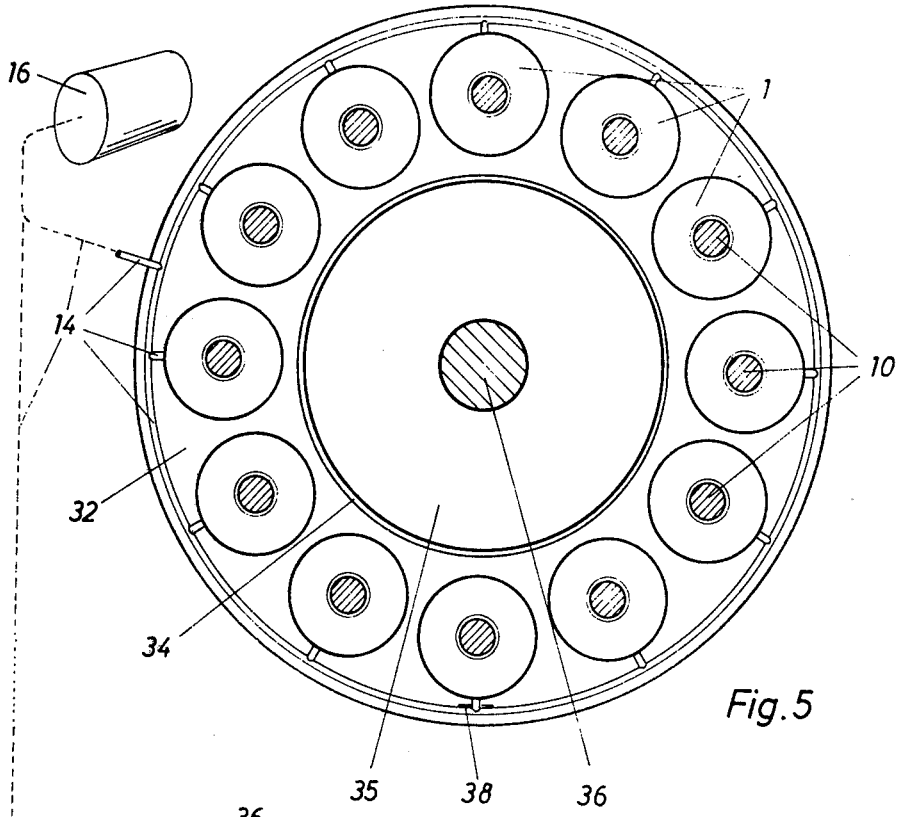
Figure 6:
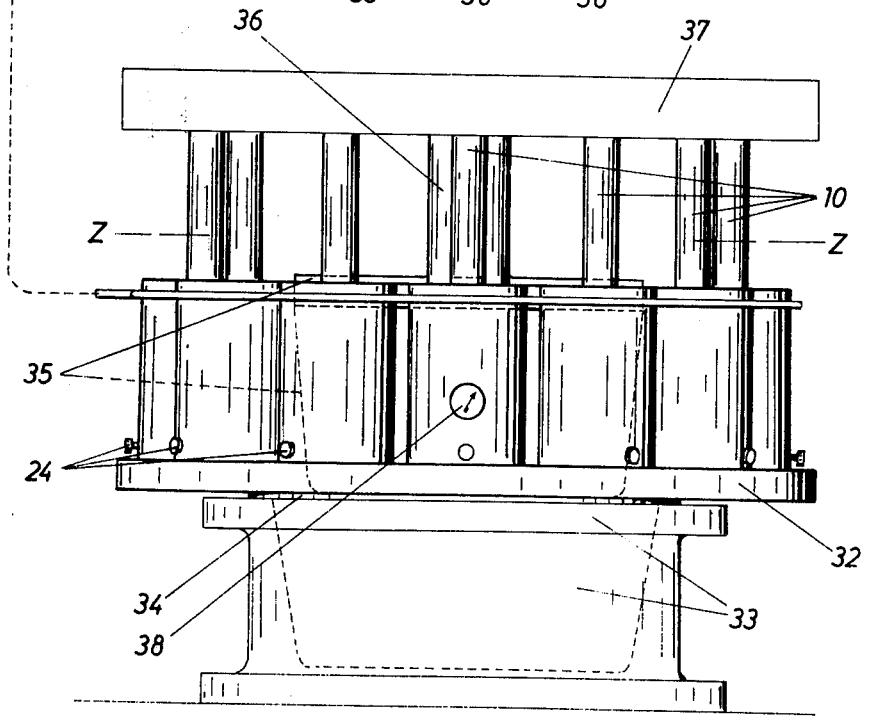

The FIGS. 5 and 6 show a plurality of holding-down elements according to the invention which are mounted on an annular-shaped holding plate 32 and form in their entirety a holding-down apparatus in accordance with the invention. The platine 34 to be worked is positioned between the holding plate 32 and the drawing matrix 33. The drawing ram 35 having ram rod 36 contacts the plate 34. The pressure plate 37 of the hydraulic drawing press (otherwise not illustrated) lies on the ram rod 36 as well as simultaneously on the piston rods 10 of the holding-down elements. The reducing valves 22 are adjusted to a holding-down force corresponding to the platine in question and the desired deformation.

As the pressure plate 37 presses downwardly towards the drawing ram 35 and the piston rods 10 of the holding-down elements, the respective pressure piston 9 in each holding-down element drives hydraulic oil from the inner cylindrical chamber 6 through the controllable reducing valve 22 into the cylindrical mantle-shaped annular chamber 7. The pressure existing in the inner cylindrical chamber 6 is constant during the entire path stroke and proportional to the pressing pressure. The proportionality is determined by the control setting at the reducing valve 22: the quicker the oil flows into the annular chamber 7, the smaller is the pressure component which is exerted against the bottom of the cylindrical chamber 6 and acts as a holding-down force on the holding plate 32 and platine border.

The oil flowing into the annular chamber 7 acts to gradually increase the oil level and to decrease the annular-shaped air space L. The pressure remains unchanged thereby, because the air space L is connected with the air pressure system of the arrangement. The pressure in air space L as well as in the entire annular chamber 7 is therefore substantially the same and constant relative to the pressure provided in the operational air pressure arrangement, normally 8 - 15 bar. The magnitude of this pressure is without significance, it must only remain approximately constant and — as it will be subsequently explained — be at least 2 bar.

The oil, which flows from the cylindrical chamber 6 through the reducing valve 22 into the annular chamber 7, encounters therein a constant back pressure and has therefore a constant flow speed from the beginning to the end of the piston movement. The holding-down force consequently remains constant during the entire deep-drawing process and exhibits the characteristic curve I illustrated in FIG. 1. By adjustment of the controllable reducing valve one can obtain the optimum characteristic curve $I_P$ for the respective deep-drawing object and for the respective platine.

If after ending the deep-drawing process the drawing pressure ceases and the drawing ram 35 as well as the piston rod 10 and piston 9 proceed upwardly, then the pressure in each inner cylindrical chamber 6 falls abruptly to zero or to a low pressure, while in annular chamber 7 the pressure of the operative air pressure arrangement continues to prevail. This pressure now opens the balance valve 28 and forces the oil from the annular chamber 7 back in sudden spurts into the inner cylindrical chamber 6. The deep-drawing process can restart from the beginning.

As already mentioned, one controls the holding-down force in which one sets the pressing pressure transmitted to the cylindrical chamber 6 by means of the reducing valve 22 to a pressure corresponding to the desired holding-down force. As a setting value, one can use the pressure value indicated by a manometer 38; the manometer is connected with the cylindrical chamber 6 by a pressure conduit 381, compare FIG. 3. The FIG. 3 illustration is only to be considered symbolically, because in practice, one connects the manometer securely with the valve bore 18, preferably through the stopper 30. In any case however, the manometer 38 must be arranged in the vicinity of control knob 24.

Figure 9:
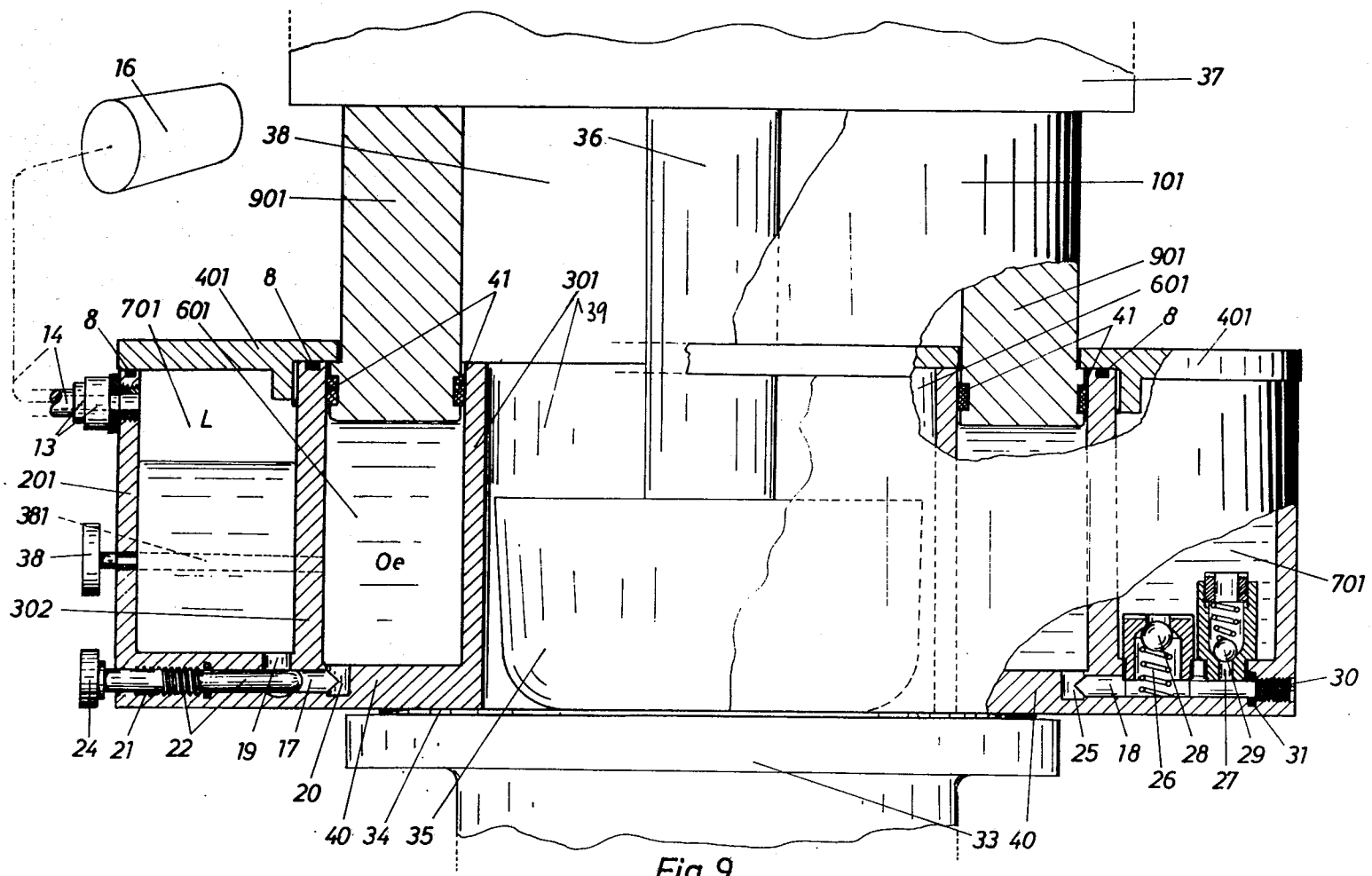

FIG. 9 shows a one-piece holding-down apparatus which simultaneously serves as a holding plate. It serves here as an interesting and advantageous embodiment of the invention which comes into question particularly for mass production in quick working times. Here, the housing 101 comprises a relatively large central upwardly and downwardly open cylindrical chamber 39 which is surrounded by a coaxial inner cylindrical wall 301, a further middle cylindrical mantle-shaped chamber 601 located between the cylindrical walls 301 and 302, and an outer cylindrical mantle-shaped chamber 701 located between 201 and 302. The cylindrical mantle-shaped chambers 601,701 include a common annular-shaped bottom 40, the outer cylindrical mantle-shaped chamber 701 has an annular-shaped housing cover 401.

Radial bores 17, 18, which in an already described manner open into vertical bores 19, 26, 27 in the bottom of the outer cylindrical mantle-shaped chamber 701 as well as in the vertical bores in the bottom of the inner cylindrical mantle-shaped chamber 601, are located — analogously to the description of the FIG. 3 embodiment — in the annular-shaped housing bottom 40 and are connected through reducing valve 22, balance valve 28, and over-pressure valve 29 with the inner cylindrical mantle-shaped chamber 601 to the outer cylindrical mantle-shaped chamber 701, as explained in the description of the FIG. 3 embodiment in all characteristics.

A cylindrical mantle-shaped pressure piston 901 equipped with sealing rings 41 projects into the inner cylindrical mantle-shaped chamber which serves as a pressure room and lies above the oil filler Oe of the pressure room. The outer cylindrical mantle-shaped chamber 701 serving as a balance room contains from 50 to 70% oil and an air room L, which is connected with the air pressure arrangement 16 of the system by means of a tubular support 13 and a pressure tube 14, over the oil. The pressure provided in the operative air pressure arrangement 16, customarily 5 to 15 bar, constantly prevails in the balance room 701.

The platine 34 is arranged between the drawing matrix 33 and the holding-down apparatus, in which the holding-down apparatus simultaneously serves as a holding plate. The drawing ram 35 positioned in the open cylindrical room 39 of the holding-down apparatus with the ram rod 36 is positioned on the platine 34. The pressing plate 37 contacts the ram rod as well as the border of the cylindrical mantle-shaped pressure piston 901.

The operation of this arrangement is analogous with that which was previously explained with the aid of FIGS. 2 through 6. The single basic difference consists in that the holding-down apparatus comprises only a single holding-down element which receives the drawing ram and serves as a holding plate. The integralness obtains the advantage that the pressure plate, drawing ram and holding-down apparatus can be combined into a unit which permits a quick lowering and lifting.

In case the system comprises no air pressure system, one can replace in an emergency situation the tubular support 13 by a sealing stopper (not illustrated). One then fills the annular-shaped air space L with air pressure having a pressure of at least 2 bar. This starting pressure is necessary so that an adequate pressure is provided at the end of the deep-drawing process in order to quickly transport the oil through the balance valve 28 into the inner cylindrical chamber 6 or the inner cylindrical mantle-shaped chamber 601. On the other hand, it is advantageous to set the starting air pressure as small as possible in order to hold the spring action of the relatively small air mass within small limits.

In this exceptional case a small biasing action occurs namely in the holding-down apparatus according to the invention which effects the characteristic curve and imparts an inclination to it. How large this inclination is, the following numerical example shall explain:

The flow occurring through the reducing valve 22 is impeded by the back pressure prevailing in the cylindrical mantle-shaped balance room 7 or 701. If the balance room is closed to the operative air pressure arrangement, then the magnitude of the back pressure plays no role, because the pressure prevailing in pressure room 6 or 601 is very much greater, and the back pressure remains constant. If, however, a considerable difference exists between the starting back pressure and the ending back pressure, then the flow speed and also the resulting holding-down force are influenced.

If for example the volume of the annular-shaped air space L is reduced in half during the course of the piston movement — the annular space 7 or 701 is essentially greater than the pressure room 6 or 601 — and the starting back pressure amounts to 2 bar, as previously stated, the end pressure climbs to approximately 4 bar. Thus a pressure difference starting back pressure — ending pressure = 2 bar comes into existence, i.e. it generates a back pressure on the flow by an effective flow-cross section 4 $mm^2$ in the reducing valve at the end phase of the deep-drawing process, which is about 0.08 kp larger than at its beginning. The flow is conducted under a pressure between 50 and 100 bar and produces a force between 2 and 4 kp subsequently at the flow-through cross-section. The characteristic curves resulting from this each form an angle of 1° or 2° with the ideal curve I of the FIG. 1, corresponding to an inclination of 2% or 4%.

The invention hereby takes a weak spring action into account which however develops in strength which by most deep-drawing operations is without significance. In spite of that it should be repeated that it affords the compromise for an exceptional case: an emergency solution, which seldom occurs in practice, since the systems in question generally have air pressure arrangements available.

In each case however this embodiment of the invention also exhibits a technical advance over the state of the art, in that essentially better results than previously have become possible without sacrificing additional volume.

Figure 8:
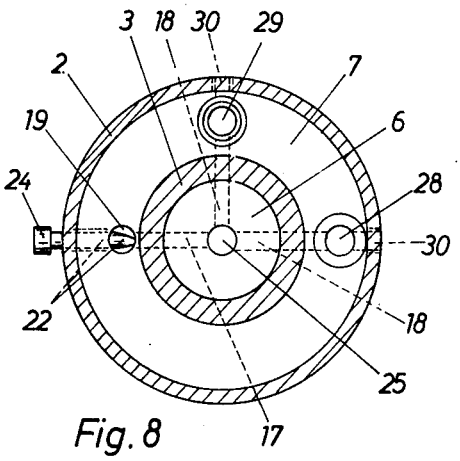
Figure 7:
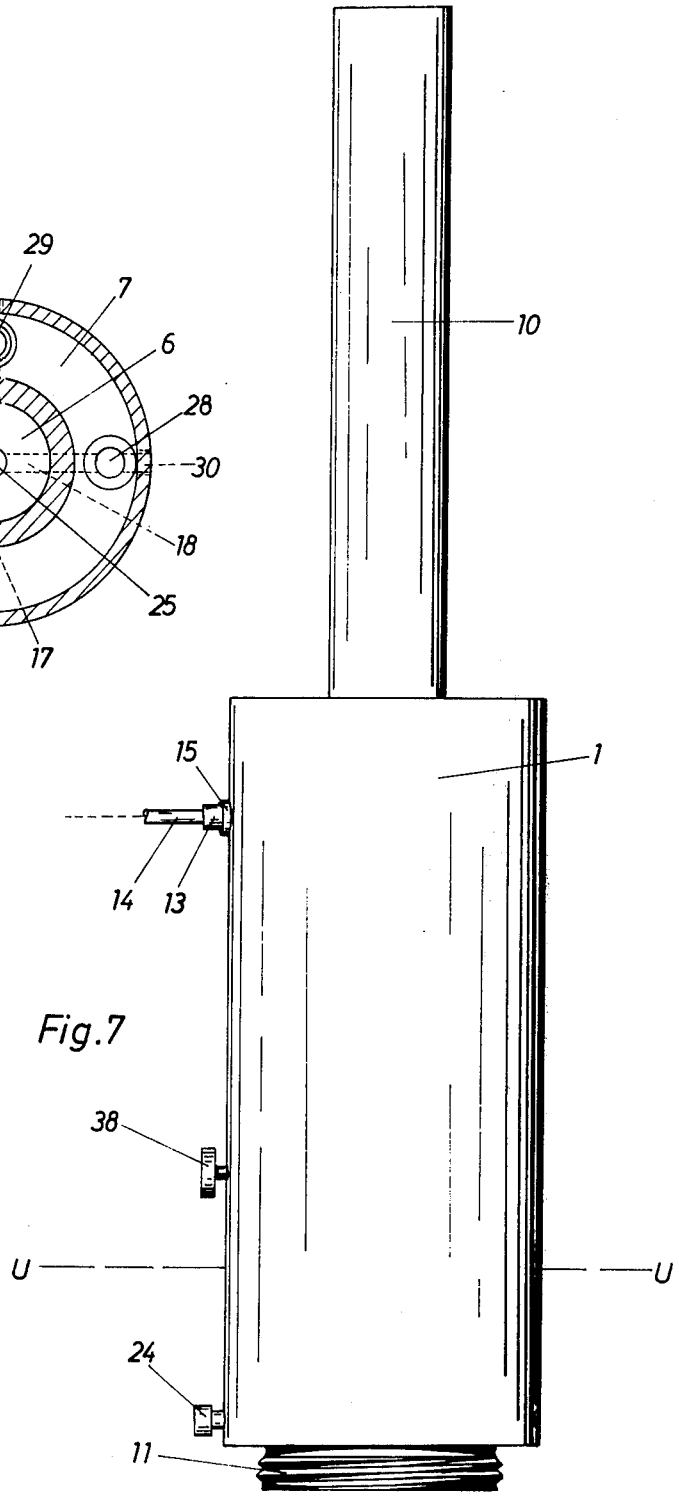

In contrast to the known holding-down elements out of steel springs the effectiveness of the holding-down elements described in the exemplary embodiments is not limited to a limited drawing stroke, but on the contrary one can adapt the holding-down element according to the invention to the length of the piston path of every deep-drawing depth practised in the art. FIG. 7 shows for example a holding-down element longitudinally extended in relation to the holding-down element illustrated in FIGS. 2 and 3, whereas FIG. 8 shows the section U—U of FIG. 7. An undismissible requirement of such a slender construction is that the volume relationship cylindrical mantle-shaped chamber 7: cylindrical chamber 6 should not fall below the value 4 : 1 (in the FIG. 3 example this relationship amounts to 5 : 1, in the FIGS. 7, 8 example 4 : 1).

Figure 2:
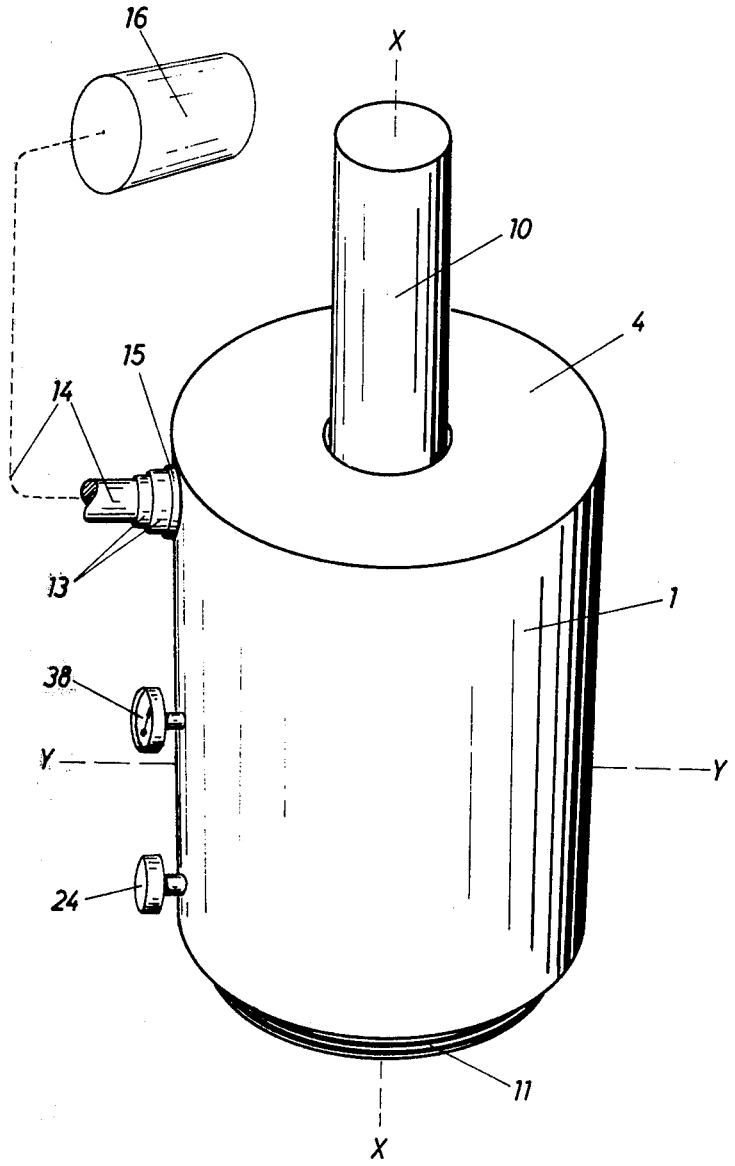

In the context of the holding-down apparatus illustrated in FIGS. 5 and 6 for circular ram- and matrix cross-section, one can with the aid of holding-down elements in accordance with the invention according to FIGS. 2 and 3 quickly and without effort equip holding plates for every conceivable ram configuration. If a plurality of workpieces are to be finished with such holding plates, then one can provide the holding plates with threaded bores which accurately correspond to the configuration, and the mounting element 11 of the hold-down element is screwed into these bores.

It was formerly valid in technical circles of the deep-drawing art as a prevailing maxim that a hold-down apparatus could only be set up out of spring elements, thus compelling elastic flexibility. The inventor of the present invention has recognized however that this maxim stands in marked contradiction to the compelling requirement of a hold-down force which is constant or at least somewhat constant during the entire deep-drawing stroke, because the characteristic curve of each spring, be it a steel- or a gas spring, forms an angle with the coordinate axes of the spring stroke, compare FIG. 1. This fact lies fundamentally in the nature of the spring tension and permits alteration by no technical artifice. Without doubt many other technical persons have also long recognized this relationship. However, no one has previously found a way for solving the problem.

The problem solution indicated by the inventor of the present invention is surprisingly simple in principle: by consciously turning away from the prevailing technical thought he makes an unelastic holding-down element. The holding-down force is in accordance with the invention not transmitted by elastic members, but on the contrary by non-elastic oil columns, which become continuously shorter during the stroke of the novel drawing ram and which constantly exert the same pressure. This pressure is controllable and is adjusted in accordance to the material, the configuration of the workpiece to be formed, and the pressing pressure.

The technical and operative advantages of this new holding-down principle which is completely unexpected for the technical world are clearly recognized from the description of the given exemplary embodiment. Finally, it should here be shortly summarized:

The holding-down force is constant during the entire deep drawing stroke (alternative: the air space L is hermetically closed as an emergency solution, by which a slight deviation occurs, The holding-down force is controllable in a simple manner, The holding-down apparatus according to the invention is simple in construction and operation and is of minimum expense, The holding-down apparatus according to the invention is uncomparably more accurate relative to the holding-down apparatuses provided with steel spring elements, and it permits execution of all practically conceivable deep-drawing processes in a single stroke — that is without steps —, The holding-down apparatus according to the invention can in all cases be selectively used as well for a deep-drawing from above downwardly, as also for a deep-drawing from below upwardly, The holding-down apparatus according to the invention can be constructed of one piece and be formed as a holding plate and centrally receive the drawing ram.

I claim:

1. In a deep-drawing press of the type in which a pressure force deforms the central portion of a plate, a holding-down apparatus for preventing marginal portions of the plate from undergoing such deformation, comprising a vessel having one chamber filled with hydraulic fluid, and another chamber communicating with said one chamber and being partly filled with hydraulic fluid and having a gas-filled space; means responsive to the pressure force for displacing hydraulic fluid in said one chamber through a restricted path towards said other chamber for thereby translating the pressure force into a holding-down force acting on marginal portions of the plate; adjustable throttling means in said path for adjusting the magnitude of said holding-down force in relation to a pressure force of predetermined magnitude; and means communicating with said gas-filled space for maintaining the adjusted magnitude of the holding-down force substantially constant during such hydraulic fluid displacement.

2. A holding-down apparatus as defined in claim 1; and further comprising means intermediate said chambers for directing hydraulic fluid flow from said other chamber towards said one chamber, said directing means including balancing means operative for establishing a pressure-equilibrium between said chambers when the pressure in said other chamber exceeds the pressure in said one chamber.

3. A holding-down apparatus as defined in claim 1; and further comprising overload means intermediate said chambers for permitting such hydraulic fluid displacement when the pressure of the hydraulic fluid in said one chamber exceeds a predetermined safety value, and for preventing such hydraulic fluid displacement when the pressure of the hydraulic fluid in said one chamber is below said predetermined safety value.

4. A holding-down apparatus as defined in claim 1, wherein said vessel, said hydraulic fluid displacing means, and said adjustable throttling means together comprise a single holding-down unit; and wherein said holding-down apparatus comprises a plurality of such units.

5. A holding-down apparatus as defined in claim 4, wherein each unit has a projection; and further comprising a holding plate having a plurality of recesses arranged in an annular array, each recess being operative for receiving a respective projection.

6. A holding-down apparatus as defined in claim 1, wherein said vessel has a longitudinal axis; and wherein said one chamber has a generally cylindrical configuration and surrounds said axis, and wherein said other chamber has a generally annular-shaped configuration, and surrounds said one chamber in coaxial relationship with said longitudinal axis.

7. A holding-down apparatus as defined in claim 1, wherein said vessel has an open end, and a cover having a hole and being in pressure-tight sealing relationship with said open end; and wherein said hydraulic fluid displacing means includes a piston extending through said hole of said cover and into said one chamber.

8. A holding-down apparatus as defined in claim 1, wherein said chambers communicate with each other through a passage; and wherein said throttling means includes a movable valve element, and means for moving said valve element in said passage between a plurality of positions for adjusting the rate of flow of hydraulic fluid along said path.

9. A holding-down apparatus as defined in claim 8, wherein said passage has a threaded section, and wherein said valve element threadedly engages said threaded section.

10. A holding-down apparatus as defined in claim 8, wherein said vessel has a longitudinal axis, and wherein said passage includes a first axially-extending bore communicating with said one chamber, a second axially extending bore communicating with said other chamber, and a transversely-extending connecting bore communicating with both of said axially-extending bores.

11. A holding-down apparatus as defined in claim 8, wherein said moving means includes an actuating handle on said valve element; and further comprising means in communication with the hydraulic fluid for indicating the pressure of the latter, said indicating means and said actuating handle being located adjacent each other.

12. A holding-down apparatus as defined in claim 1, wherein said vessel has a longitudinal axis; and wherein said chambers communicate with each other through a drainage channel, said drainage channel including an axially-extending bore communicating with said one chamber, and a transversely-extending bore communicating with said axially-extending bore; and further comprising a closure member intermediate said drainage channel and exterior of the vessel and operative for obstructing the flow of hydraulic fluid towards the exterior of the vessel.

13. A holding-down apparatus as defined in claim 12, and further comprising means intermediate said chambers for directing hydraulic fluid flow from said other chamber towards said one chamber; and also comprising overload means intermediate said chambers for directing said fluid flow from said one chamber towards said other chamber; and wherein said directing means and said overload means each communicate with said drainage channel.

14. A holding-down apparatus as defined in claim 1, wherein said vessel has a longitudinal axis; and wherein said one chamber has a generally annular-shaped configuration surrounding said axis, and wherein said other chamber also has a generally annular-shaped configuration coaxially surrounding said one chamber.

15. A holding-down apparatus as defined in claim 14, wherein said vessel includes a passage having opposite open ends through which a drawing ram of the deep-drawing press is passable, said chambers surrounding said passage in coaxial relationship.

16. A holding-down apparatus as defined in claim 14, and further comprising means for sealing said gas filled space from the exterior of the vessel.

* * * * *